US005195495A

United States Patent [19]

Kitamoto et al.

[11] Patent Number: 5,195,495

[45] Date of Patent: Mar. 23, 1993

[54] EVAPORATIVE FUEL-PURGING CONTROL SYSTEM FOR INTERNAL COMBUSTION ENGINES

[75] Inventors: Masakazu Kitamoto; Fumio Hosoda; Hideo Moriwaki; Sachito Fujimoto, all of Wako, Japan

[73] Assignee: Honda Giken Kogyo Kabushiki Kaisha, Tokyo, Japan

[21] Appl. No.: 921,158

[22] Filed: Jul. 29, 1992

[30] Foreign Application Priority Data

Aug. 2, 1991 [JP] Japan ..... 3-216357

[51] Int. Cl.[5] ..... F02M 33/02

[52] U.S. Cl. ..... 123/520; 123/518

[58] Field of Search ..... 123/518, 519, 520, 521, 123/516

[56] References Cited

U.S. PATENT DOCUMENTS

| | | | |
|---|---|---|---|
| 4,641,623 | 2/1987 | Hamburg | 123/518 |
| 4,741,317 | 5/1988 | Yost | 123/518 |
| 4,748,959 | 6/1988 | Cook | 123/520 |
| 4,763,634 | 8/1988 | Morozumi | 123/520 |
| 4,809,667 | 3/1989 | Uranishi | 123/518 |
| 4,865,000 | 9/1989 | Yajima | 123/520 |
| 4,967,713 | 11/1990 | Kojima | 123/519 |
| 5,020,503 | 6/1991 | Kanasashi | 123/519 |

FOREIGN PATENT DOCUMENTS

| | | | |
|---|---|---|---|
| 62-131962 | 6/1987 | Japan . | |
| 62-233466 | 10/1987 | Japan . | |
| 63-111277 | 5/1988 | Japan . | |
| 3-286173 | 12/1991 | Japan | 123/518 |

*Primary Examiner*—Carl S. Miller

*Attorney, Agent, or Firm*—Nikaido, Marmelstein, Murray & Oram

[57] ABSTRACT

An evaporative fuel-purging control system for an internal combustion engine having a canister in which evaporative fuel from a fuel tank is adsorbed. One or more purging control valves are arranged across a purging pipe extending between the canister and an intake system. An ECU integrates an estimated value of a flow rate of evaporative fuel supplied to the engine, which is estimated as a purging flow rate in the purging pipe, in accordance with engine operating conditions when a specific one of the purging control valves is opened to thereby obtain an integrated purging flow rate value, and subtracts a predetermined decremental value from the integrated purging flow rate value when the specific one purging control valve is closed. When the integrated purging flow rate value is equal to or smaller than a predetermined lower limit value, the ECU decreases the flow rate of the evaporative fuel supplied to the intake system, based on the integrated purging flow rate value obtained above. When an air-fuel ratio correction coefficient value is equal to or greater than a predetermined value and at the same time the integrated purging flow rate value is equal to or greater than a predetermined value, the ECU increases the flow rate, based upon the integrated purging flow rate value.

16 Claims, 6 Drawing Sheets

*FIG.3*

| θ TH / NE | THQPG0 | THQPG1 | ····· | THQPG7 |
|---|---|---|---|---|
| NQPG0 | QPG(0,0) | QPG(0,1) | ····· | QPG(0,7) |
| NQPG1 | QPG(1,0) | QPG(1,1) | ····· | QPG(1,7) |
| NQPG2 | QPG(2,0) | QPG(2,1) | ····· | QPG(2,7) |
| NQPG3 | QPG(3,0) | QPG(3,1) | ····· | QPG(3,7) |

EVAPORATIVE FUEL-PURGING CONTROL SYSTEM FOR INTERNAL COMBUSTION ENGINES

BACKGROUND OF THE INVENTION

1. Field of the Invention

This invention relates to an evaporative fuel-purging control system for internal combustion engines, and more particularly to an evaporative fuel-purging control system of this kind which controls the flow rate at which evaporative fuel is purged into the intake system of the engine.

2. Prior Art

Conventionally, evaporative fuel-purging control systems have been widely used in internal combustion engines, which operate to prevent evaporative fuel from being emitted from a fuel tank into the atmosphere, by temporarily storing evaporative fuel from the fuel tank in a canister, and purging same into the intake system of the engine. Purging of evaporative fuel into the intake system causes instantaneous enriching of an air-fuel mixture supplied to the engine. If the purged evaporative fuel amount is small, the air-fuel ratio of the mixture will then be promptly returned to a desired value, with almost no fluctuation.

However, if the purged amount is large, the air-fuel ratio of the mixture fluctuates. To prevent such fluctuations, there have been proposed the following systems:

(i) A purging gas flow rate control system which reduces the purging amount from the start of the engine immediately after refueling or fill-up until the speed of a vehicle in which the engine is installed reaches a predetermined value, and also reduces the purging amount after the vehicle speed has reached the predetermined value and until the accumulated time period during which the vehicle speed exceeds the predetermined value reaches a predetermined time period, to thereby prevent fluctuations in the air-fuel ratio due to purging immediately after a fill-up when a large amount of fuel vapor can be produced in the fuel tank (e.g. Japanese Provisional Patent Publication (Kokai) No. 63-111277);

(ii) An air-fuel ratio control system which effects purging of evaporative fuel in such a small amount as to cause almost no fluctuation of the air-fuel ratio, detects an amount of variation of an air-fuel ratio correction coefficient applied to feedback control of the air-fuel ratio, which is caused by the purging, forecast from the detected variation amount a value of the air-fuel ratio correction coefficient which should be assumed when the purging amount is large, and applies the forecast value as the air-fuel ratio correction coefficient in the feedback control when the actual purging amount becomes large, so as to reduce the fuel amount supplied to the engine, whereby fluctuations in the air-fuel ratio can be suppressed even when the purging amount is large (e.g. Japanese Provisional Patent Publication (Kokai) No. 62-131962);

(iii) A purging gas flow rate control system which employs a plurality of purge control valves, and calculates a forecast value of an air-fuel ratio correction coefficient to be applied during large-amount purging, based upon values of the correction coefficient assumed during stoppage of the purging and during small-amount purging, and inhibits large-amount purging when the forecast value exceeds a predetermined value (e.g. Japanese Provisional Patent Publication (Kokai) No. 62-233466).

When a throttle value of an internal combustion is fully closed or almost fully closed over a long time period, for example, at parking idle or deceleration, an amount of intake air supplied to the engine is small, and accordingly, purging of evaporative fuel to the intake system is stopped to prevent fluctuations in the air-fuel ratio. However, even when the throttle valve is fully closed or almost fully closed, evaporative fuel flows into the canister from the fuel tank. Therefore, there is a possibility that the canister becomes saturated with evaporated fuel adsorbed therein.

As a result, when the throttle valve is opened and fuel purging to the intake system is resumed while the canister is in such a saturated state, a large amount of evaporative fuel is supplied to the engine from the canister via the intake system so that the air-fuel ratio of the mixture largely changes to the rich side, which can result in a misfire. Furthermore, such enriched mixture will cause degraded accelerability, because the engine rotational speed cannot be raised even if the accelerator pedal is stepped on.

The above system (i) merely reduces the purging amount under predetermined conditions determined by the vehicle speed and the predetermined time period after a fill-up. The systems (ii) and (iii) merely attempt to suppress fluctuations in the air-fuel ratio by forecasting a value of the air-fuel ratio correction coefficient to be assumed when the purging amount is large, from an amount of variation of the air-fuel ratio correction coefficient during small-amount purging or during stoppage of the purging. Therefore, the systems (i)-(iii) cannot solve the above-described problems encountered when the purging is resumed after stoppage of the purging.

SUMMARY OF THE INVENTION

It is an object of the invention to provide an evaporative fuel-purging control system for an internal combustion engine, which is capable of suppressing fluctuations in the air-fuel ratio even when the purging is resumed after stoppage of the purging, to thereby achieve desired driveability.

To attain the above-mentioned object, according to a first aspect of the invention, there is provided an evaporative fuel-purging control system for an internal combustion engine having an intake system, a fuel tank, a canister in which evaporative fuel from the fuel tank is adsorbed, a purging passage extending between the canister and the intake system, and purging control valve means arranged across the purging passage for controlling a flow rate of the evaporative fuel supplied from the canister to the intake system through the purging passage.

The evaporative fuel-purging control system according to the first aspect is characterized by an improvement comprising:

purging flow rate-calculating means for integrating an estimated value of the flow rate of the evaporative fuel which is estimated as an allowable purging flow rate in the purging passage in accordance with operating conditions of the engine when the purging control valve means is open to thereby obtain an integrated purging flow rate value, and substracting a predetermined decremental value from the integrated purging flow rate value when the purging control value means is closed; and purging flow rate-decreasing means for decreasing the flow rate of the evaporative fuel supplied to the intake system via the purging control valve means when the integrated purging flow rate value obtained by the purging flow rate-calculating means is equal to or smaller than a predetermined lower limit value.

Preferably, the purging flow rate-decreasing means decreases the flow rate of the evaporative fuel based upon the integrated purging flow rate value obtained by the purging flow rate-calculating means.

More preferably, the purging flow rate-decreasing means decreases the flow rate of the evaporative fuel by duty-controlling the purging control valve means, based on the integrated purging flow rate value.

Further, according to a second aspect of the invention, there is provided an evaporative fuel-purging control system for an internal combustion engine having an intake system, an exhaust system, a fuel tank, a canister in which evaporative fuel from the fuel tank is adsorbed, a purging passage extending between the canister and the intake system, purging control valve means arranged across the purging pipe for controlling a flow rate of the evaporative fuel supplied from the canister to the intake system, exhaust gas ingredient concentration sensor means arranged in the exhaust system, and air-fuel ratio control means responsive to an output from the exhaust gas ingredient concentration sensor means for calculating an air-fuel ratio correction coefficient, based upon the output from the exhaust gas ingredient concentration sensor and controlling the air-fuel ratio of a mixture supplied to the engine by the use of the air-fuel ratio correction coefficient.

The evaporative fuel-purging control system according to the second aspect is characterized by an improvement comprising:

purging flow rate-calculating means for integrating an estimated value of the flow rate of the evaporative fuel which is estimated as an allowable purging flow rate in the purging passage in accordance with operating conditions of the engine when the purging control valve means is open to thereby obtain an integrated purging flow rate value, and subtracting a predetermined decremental value from the integrated purging flow rate value when the purging control valve means is closed; and purging flow rate-increasing means for increasing the flow rate of the evaporative fuel supplied to the intake system via the purging control valve means when the air-fuel ratio correction coefficient has a value equal to or greater than a predetermined value and at the same time the integrated purging flow rate value obtained by the purging flow rate calculating means is equal to or greater than a predetermined value.

Preferably, the purging flow rate increasing means increases the flow rate of the evaporative fuel, based upon in the integrated purging flow rate value.

More preferably, the purging flow rate-increasing means increases the flow rate of the evaporative fuel by duty-controlling the purging control valve means, based upon the integrated purging flow rate value.

Further preferably, the flow rate of the evaporative fuel supplied to the intake system via the purging control valve means is decreased based upon the integrated purging flow rate value when the air-fuel ratio correction coefficient has a value smaller than the predetermined value.

The purging control valve means may comprise a first purging control valve arranged across the purging passage at a location between the canister and the intake system, a negative pressure valve arranged across the purging passage at a location between the first purging control valve and the canister, and a second purging control valve arranged between the negative pressure valve and the intake system for controlling opening of the negative pressure valve by applying vacuum from the intake system thereto. Alternatively, the purging control valve means may be formed by a single flow-rate control valve, or the purging control valve means may comprise a plurality of on-off type purging control valves.

According to the first aspect of the invention, when the integrated purging flow rate value is equal to or smaller than the predetermined lower limit value, that is, when the evaporative fuel stored in the canister is estimated to be large, the purging flow rate is decreased. Therefore, it can be prevented that a large amount of evaporative fuel is supplied from the canister to the intake system when the purging is resumed after its stoppage. As a result, overriching of the air-fuel ratio can be prevented to thereby avoid degraded driveability such as degraded accelerability.

Further, according to the second aspect of the invention, when the air-fuel ratio correction coefficient value is equal to to greater than the first predetermined value and at the same time the integrated purging flow rate value is equal to or greater than the second predetermined value, that is, when it is estimated that the air-fuel ratio is lean and at the same time the evaporative fuel stored in the canister is not large in amount, the purging flow rate is increased. Therefore, when while the evaporative fuel is continuously supplied to the intake system, there is a need to increase the amount of fuel supplied to the engine, the air-fuel ratio can be controlled to a desired value by increasing the purging flow rate, without fluctuations in the air-fuel ratio. As a result, desired driveability can be secured.

The above and other objects, features, and advantages of the invention will be more apparent from the ensuring detailed description taken in conjunction with the acompanying drawings.

BRIEF DESCRIPTION OF THE DRAWINGS

FIG. 3 is a view showing a QPG map which is retrieved during execution of the program of FIG. 2;

DETAILED DESCRIPTION

The invention will now be described in detail with reference to the drawings showing embodiments thereof.

Figure 1:
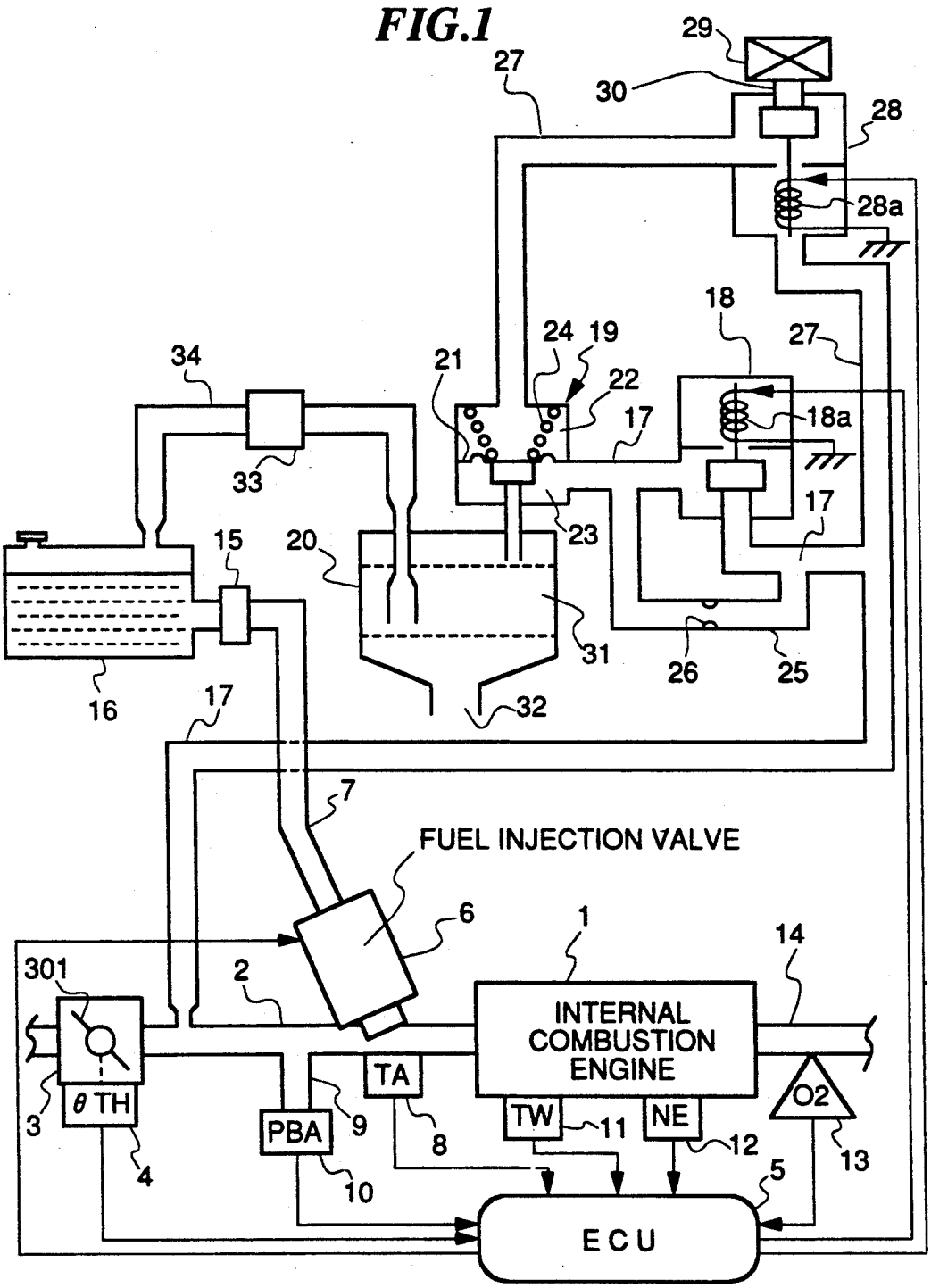
FIG. 1 is a block diagram showing the whole arrangement of an evaporative fuel-purging control system for use in an internal combustion engine, according to a first embodiment of the invention.

Referring first to FIG. 1, there is illustrated the whole arrangement of an evaporative fuel-purging control system for use in an internal combustion engine, according to a first embodiment of the invention. In the figure, reference numeral 1 designates an internal combustion engine for automotive vehicles. The engine is a four-cylinder type, for instance. Connected to the cylinder block of the engine 1 is an intake pipe 2 across which is arranged a throttle body 3 accommodating a throttle valve 301 therein. A throttle valve opening ($\theta_{TH}$) sensor 4 is connected to the throttle valve 301 for generating an electric signal indicative of the sensed throttle valve opening and supplying same to an electronic control unit (hereinafter called "the ECU") 5.

Fuel injection valves 6, only one of which is shown, are inserted into the interior of the intake pipe 2 at locations intermediate between the cylinder block of the engine 1 and the throttle valve 301 and slightly upstream of respective intake valves, not shown. The fuel injection valves 6 are connected to a fuel tank 16 via a fuel pump 15, and electrically connected to the ECU 5 to have their valve opening periods controlled by signals therefrom.

On the other hand, an intake pipe absolute pressure (PBA) sensor 10 is provided in communication with the interior of the intake pipe 2 via a conduit 9 at a location immediately downstream of the throttle valve 301 for supplying an electric signal indicative of the sensed absolute pressure within the intake pipe 2 to the ECU 5.

An intake air temperature (TA) sensor 8 is mounted on the wall of the intake pipe 2 downstream from the conduit 9. The TA sensor 8 generates an electric signal indicative of the sensed intake air temperature TA and supplies same to the ECU 5.

An engine coolant temperature (TW) sensor 11, which may be formed of a thermistor or the like, is mounted in the cylinder block of the engine 1, for supplying an electric signal indicative of the sensed engine coolant temperature TW to the ECU 5. An engine rotational speed (Ne) sensor 12 is arranged in facing relation to a camshaft or a crankshaft of the engine 1, not shown. The engine rotational speed sensor 12 generates a pulse as a TDC signal pulse at each of predetermined crank angles whenever the crankshaft rotates through 180 degrees, the pulse being supplied to the ECU 5.

An $O_2$ sensor 13 as an exhaust gas ingredient concentration sensor is mounted in an exhaust pipe 15 connected to the cylinder block of the engine 1, for sensing the concentration of oxygen present in exhaust gases emitted from the engine 1 and supplying an electric signal indicative of a detected value of the oxygen concentration to the ECU 5.

A purging pipe 17 extends from the intake pipe 2 at a location between the throttle valve 301 and the conduit 9, to a canister 20, across which are arranged a first purging control valve 18 and a negative pressure valve 19.

The canister 20 has an adsorbent 31 formed, for example, of activated carbon, and an outside air intake port 32. The canister 20 is connected to the fuel tank 16 via a communication pipe 34 having a two-way valve 33 arranged thereacross.

The negative pressure valve 19 has a negative pressure chamber 22 and a purging chamber 23 defined by a diaphragm 21 at upper and lower sides of the valve 19. A spring 24 is arranged in the negative pressure chamber 22, which urges the diaphragm 21 in a direction in which the valve 19 is closed. The purging chamber 23 is connected to the purging pipe 17 for communication with the intake pipe 2 via the first purging control valve 18.

The first purging control valve 18 has a solenoid 18*a* electrically connected to the ECU 5. The first purging control valve 18 is duty-controlled by a control signal from the ECU 5 to control the purging flow rate through the purging pipe 17 in response to engine operating parameters, such as the engine rotational speed NE and the engine coolant temperature TW, as well as the concentration of evaporative fuel.

In FIG. 1, reference numeral 25 designates a bypass pipe bypassing the first purging control valve 18, which has a jet restriction 26 for suppressing fluctuations in the purging flow rate in the purging pipe 17.

A negative pressure communication pipe 27 is connected to the negative pressure chamber 22 of the negative pressure valve 19 such that the negative pressure chamber 22 can be communicated with the purging pipe 17 via the negative pressure communication pipe 27 and a second purging control valve 28 arranged across the pipe 27.

The second purging control valve 28 has an atmosphere intake passage 30 having an air filter 29 mounted at its open end, and a solenoid 28*a* electrically connected to the ECU 5 such that when the solenoid 28*a* is energized, the negative pressure communication pipe 27 is opened so that vacuum is introduced via the purging pipe 17 and the negative pressure communication pipe 27 to thereby open the negative pressure valve 19, whereas when the solenoid 28*a* is de-energized, atmosphere is supplied to the negative pressure chamber 22 via the atmoshpere-communication passage 30 to thereby close the negative pressure valve 19.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") which carries out various operational programs, described hereinafter, etc., memory means storing a Ti map, referred to hereinafter, and the operational programs which are executed by the CPU and for storing results of calculations therefrom, etc., and an output circuit which outputs driving signals to the fuel injection valves 6 and the first and second purging control valves 18, 28.

The CPU operates in response to output signals from the above-mentioned sensors to determine operating conditions in which the engine 1 is operating, such as an air-fuel ratio feedback control region in which the air-fuel ratio is controlled in response to the detected oxygen concentration in the exhaust gases, and open-loop control regions, and calculates, based upon the determined operating conditions, the valve opening period of fuel injection period TOUT over which the fuel injection valves 6 are to be opened, by the use of the following equation in synchronism with generation of TDC signal pulses to the ECU 5:

$$TOUT = Ti \times K1 \times KO2 + K2 \quad (1)$$

where Ti represents a basic value of the fuel injection period TOUT of the fuel injection valves 6, which is read from the Ti map in accordance with the engine rotational speed Ne and the intake pipe absolute pressure PBA, for example.

KO2 represents an air-fuel ratio feedback correction coefficient whose value is determined in response to the oxygen concentration in the exhaust gases detected by the $O_2$ sensor 13, during feedback control, of the air-fuel ratio while it is set to respective predetermined appropriate values while the engine is in predetermined operating regions (the open-loop control regions) other than the feedback control region.

K1 and K2 represent other correction coefficients and correction variables, respectively, which are calculated based on various engine operating parameter signals to such values as to optimize characteristics of the engine such as fuel consumption and accelerability depending on operating conditions of the engine.

Evaporative fuel or gas (hereinafter merely referred to as "evaporative fuel") generated within the fuel tank 16 forcibly opens a positive pressure valve of the two-way valve 33 when the pressure of the evaporative fuel reaches a predetermied level, to flow through the valve 33 into the canister 20, where the evaporative fuel is adsorbed by the adsorbent 31 and thus stored therein.

When the amount of intake air supplied to the engine is small, for example, at parking idle or deceleration, the second purging control valve 28 is de-energized so that the atmosphere is supplied to the negative pressure chamber 22 via the atmosphere intake passage 30 to thereby allow the negative pressure valve 19 to be closed by the urging force of the spring 24.

On the other hand, when the throttle valve 301 is opened to start a vehicle in which the engine is installed and the intake air amount is increased, the second purging control valve 28 is energized, whereby the negative pressure chamber 22 of the negative pressure valve 19 becomes communicated with the intake pipe 2 so that the diaphragm 21 is upwardly deformed by vacuum from the intake pipe 2 against the force of the spring 24 to thereby open the negative pressure valve 19. As a result, the canister 20 becomes communicated with the purging pipe 17 via the negative pressure chamber 22 and then, the purging amount supplied to the intake pipe 2 is controlled by duty-controlling the first purging control valve 18.

When the second purging control valve 28 is energized to cause the negative pressure valve 19 to be opened as described above, evaporative fuel temporarily stored in the canister 20 is supplied together with atmosphere from the outside air intake part 32 to the intake pipe 2 via the first purging control valve 18 and the bypass pipe 25, due to vacuum from the intake pipe 2, and then to each cylinder of the engine.

When the negative pressure in the fuel tank 16 increases due to cooling of the fuel tank 16 by outside air etc., a negative pressure valve of the two-way valve 33 is opened to thereby cause part of evaporative fuel temporarily stored in the canister 20 to be returned to the fuel tank 16.

According to this embodiment, when the second purging control valve 28 is open, the ECU 5 integrates or accumulates an estimated value QPQ of the purging flow rate which is estimated as the allowable purging flow rate that can be supplied through the purging pipe 17 to the engine, in accordance with engine operating conditions, e.g. the engine rotational speed NE and throttle valve opening θTH, to thereby obtain an integrated value QPGP of the purging flow rate. Inversely, when the second purging control value 28 is closed, the ECU 5 substracts a predetermined decremental value QPD from the integrated purging flow rate value QPGP to obtain a new integrated value QPGP.

When the integrated value QPGP is equal to or smaller than a predetermined lower limit value QPGPL, the ECU 5 decreases the purging amount supplied to the intake pipe 2 via the first purging control valve 18, based upon the integrated purging flow rate value QPGP.

When the value of the air-fuel ratio correction coefficient KO2 is equal to or greater than a predetermined value KO2LMT and at the same time the integrated purging flow rate value QPGP is equal to or greater than a predetermined upper limit value QPGPH, the ECU 5 increases the purging amount, based upon the integrated purging flow rate value QPGP.

That is, the integrated purging flow rate value QPGP corresponds to the purging amount that is allowed to be supplied to the engine. Therefore, the integrated purging flow rate value QPGP will be hereinafter referred to as "the allowable purging flow rate".

Figure 2:
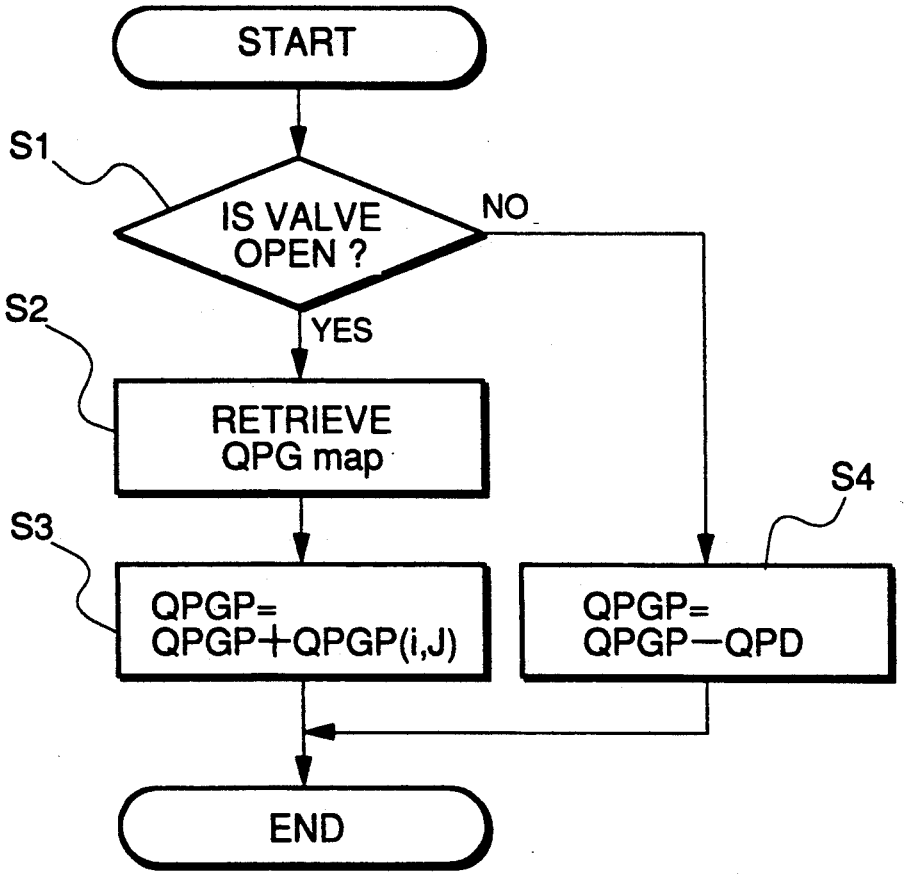
FIG. 2 is a flowchart of a program for calculating an integrated or accumulated value (QPGP) of a purging flow rate.

FIG. 2 shows a program for calculating the purging flow rate QPGP, which is carried out by the CPU of the ECU 5. This program is executed in synchronism with generation of each TDC signal pulse, or at fixed time intervals, or as background processing.

First, it is determined at a step S1 whether or not the second purging control valve 28 is open. If the answer to the question of the step S1 is affirmative (YES), a QPG map is retrieved at a step S2. The QPG map is shown in FIG. 3, where map values QPG (i, j) (i=0–3, j=0–7) are set as a function of combinations of predetermined engine rotational speed values NQPG0–3 and predetermined throttle valve opening values TQPG0–7. At the step S2, a map value QPG (i, j) is read out in accordance with the engine rotational speed NE detected by the NE sensor 12 and the throttle valve opening θTH detected by the θTH sensor 4.

Then, a value of the allowable purging flow rate QPGP in the present loop is calculated by the use of the following equation (2), and the result of the calculation is stored into the memory means of the ECU 5 (step S3), followed by terminating the program:

$$QPGP = QPGP + QPG(i, j) \quad (2)$$

where QPGP on the right side of the equation (2) is an value calculated in the last loop.

The allowable purging flow rate QPG is sequentially renewed by repeating the above addition at the step S3.

On the other hand, if the answer to the question of the step S1 is negative (NO), the program proceeds to a step S4 to subtract the predetermined decremental value QPD from the allowable purging flow rate QPGP calculated in the last loop at the step S3 or S4 by the use of the following equation (3), to thereby renew the allowable purging flow rate QPGP, and the renewed QPG value is stored into the memory means of the ECU, followed by terminating the program:

$$QPGP = QPGP - QPD \quad (3)$$

The predetermined decremental value QPD is set to such a value as can prevent a large amount of evaporative fuel from being purged into the intake pipe 2 when the second purging control valve 28 is opened from its closed position. For example, the QPD value may be set to a value corresponding to an amount of evaporative fuel flowing into the canister 20 instantaneously when the second purging control valve 28 is closed, or to an estimated value thereof.

Figure 4:
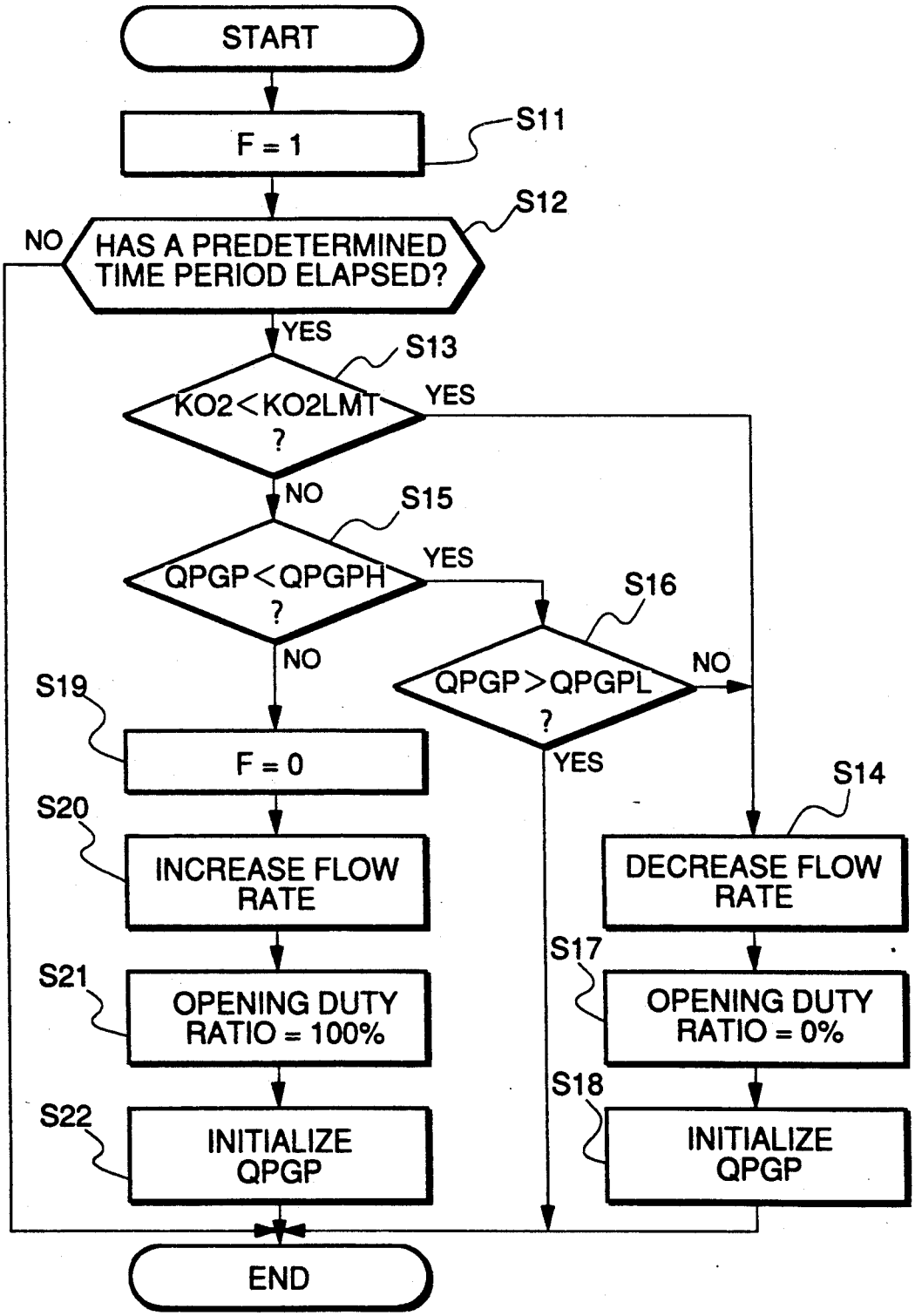
FIG. 4 is a flowchart of a program for controlling the purging flow rate.

FIG. 4 shows a program for controlling the purging flow rate, which is carried out by the CPU. This program is executed at fixed time intervals after the engine is warmed up.

First, at a step 11, a flag F is set to a value of 1, to set the control mode to a purging flow rate-decreasing mode. Then, it is determined at a step S12 whether or not a predetermined time period has elapsed after the flag F was set to a value of 1. The step S12 is based upon the ground that the purging flow rate control should be inhibited for a certain time period after the purging is resumed, because there is a time lag between resumption of the purging by opening of the second purging control valve 28 and calculation of the air-fuel ratio correction coefficient KO2 based upon the air-fuel ratio detected by the O2 sensor 13. Therefore, if the answer to the question of the step S12 is negative (NO), the program is immediately terminated. On the other hand, if the answer to the question of the step S12 is affirmative (YES), the program proceeds to a step S13 to determine whether or not the value of the air-fuel ratio correction coefficient KO2 is smaller than a predetermined lower limit value KO2LMT (e.g. 0.4) as a first predetermined value.

If the answer to the question of the step S13 is affirmative (YES), i.e. if the value of the air-fuel ratio correction coefficient KO2 is very small, the program proceeds to a step S14 to control the purging flow rate so as to prevent large enriching of the air-fuel ratio.

On the other hand, if the answer to the question of the step S13 is negative (NO), the program proceeds to a step S15 to determine whether or not the allowable purging flow rate QPGP is smaller than the predetermined upper limit value QPGPH. If the answer to the question of the step S15 is affirmative (YES), it is determined at a step S16 whether or not the allowable purging flow rate QPGP is greater than the predetermined lower limit value QPGPL. If the answer to the question of the step S16 is affirmative (YES), the program is immediately terminated. On the other hand, if the answer to the question of the step S16 is negative (NO), i.e. if QPGP≦QPGPL, which means that a large amount of evaporative fuel is stored in the canister 20, the program proceeds to the step S14.

At the step S14, the first purging control valve 18 is duty-controlled based on the allowable purging flow rate QPGP calculated at the step S4 in FIG. 2, so as to decrease the purging flow rate. Then, limit checking is executed so that the opening duty ratio of the first purging control valve 18 is not less than 0 %, at a step S17. Then, the allowable purging flow rate QPGP is initialized at a step S17, and the program is terminated.

On the other hand, if the answer to the question of the step S13 is negative (NO) and at the same time the answer to the question of the step S15 is negative (NO), i.e. if the value of the air-fuel ratio correction coefficient KO2 does not assume a very small value, which means that the air-fuel ratio of the mixture supplied to the engine is not so rich, and the allowable purging flow rate QPGP is large, which means that fluctuations in the air-fuel ratio can be suppressed even if a large amount of purging is effected, the flag F is set to a value of 0, to set the control mode to a purging flow rate-increasing mode (step S19). Then, the first purging control valve 18 is duty-controlled based on the allowable purging flow rate QPGP calculated at the step S3 in FIG. 2, so as to increase the purging flow rate (step S20), limit checking is executed so that the opening duty ratio of the first purging control valve 18 is not more than 100% (step S21), the allowable purging flow rate QPGP is initialized (step S22), and the program is terminated.

Figure 5:
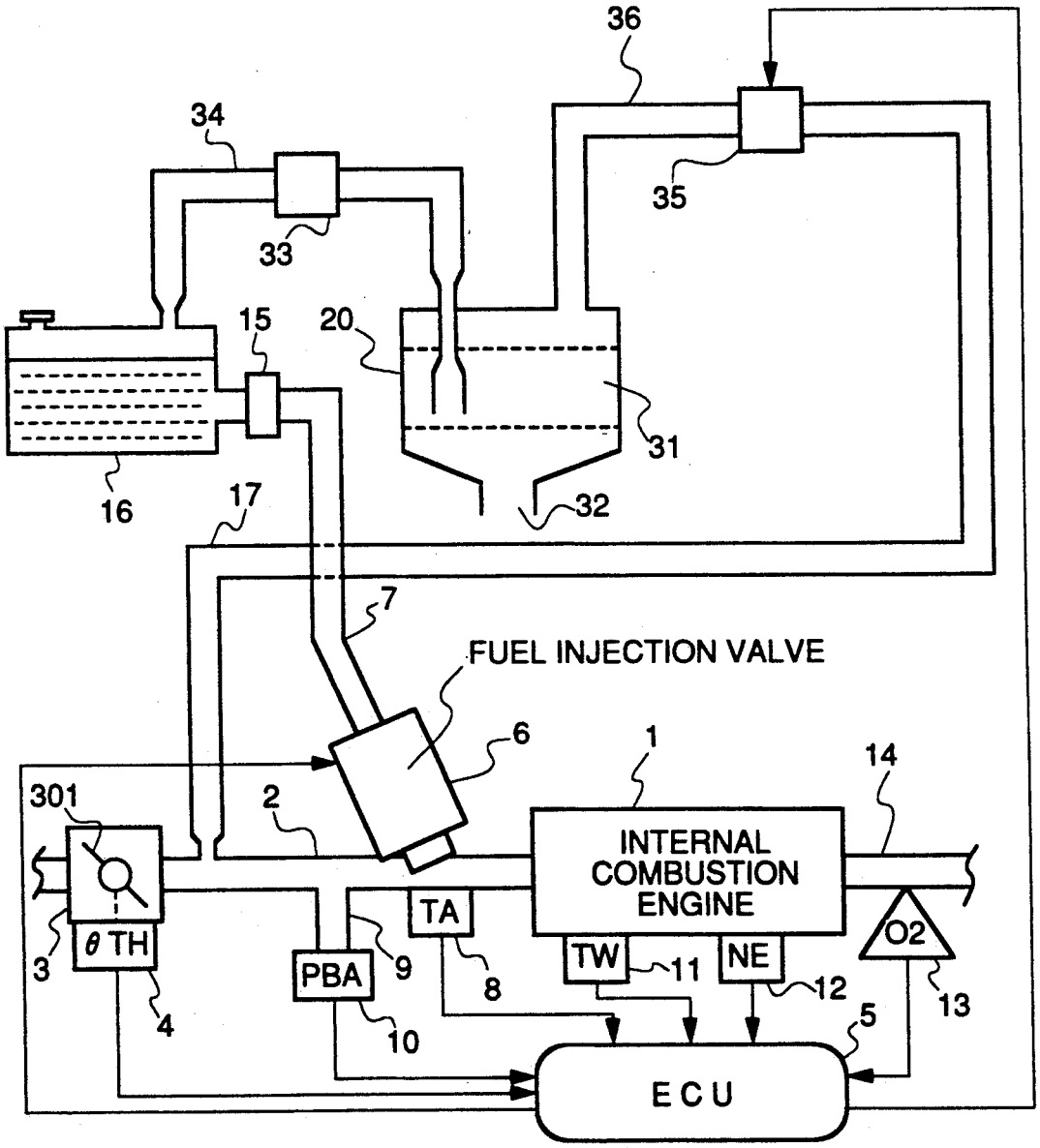
FIG. 5 is a block diagram showing the whole arrangement of an evaporative fuel-purging control system for use in an internal combustion engine, according to a second embodiment of the invention.

FIG. 5 shows the whole arrangement of an evaporative fuel-purging control system for use in an internal combustion engine, according to a second embodiment of the invention. In FIG. 5, elements and parts corresponding to those in FIG. 1 are designated by identical reference numerals, and description thereof is omitted.

In the second embodiment, as shown in FIG. 5, a single flow-rate control valve 35 is provided as a purging control valve, which is arranged across a purging pipe 36, instead of the first purging control valve 18, the negative pressure valve 19, and the second purging control valve 28 employed in the above described first embodiment. The flow-rate control valve 35 is duty-controlled to vary the purging flow rate by a duty control signal supplied from the ECU 5. Alternatively, the flow-rate control valve 35 may be of the linear solenoid type which is controlled to linearly vary the purging flow rate by a current signal from the ECU 5. The calculation of the allowable puring flow rate QPGP and the decrease and increase of the purging flow rate are carried out in a manner similar to the first embodiment.

According to the second embodiment, the system can be simplified in construction because the purging flow rate is controlled by a single purging control valve (flow-rate control valve 35).

Figure 6:
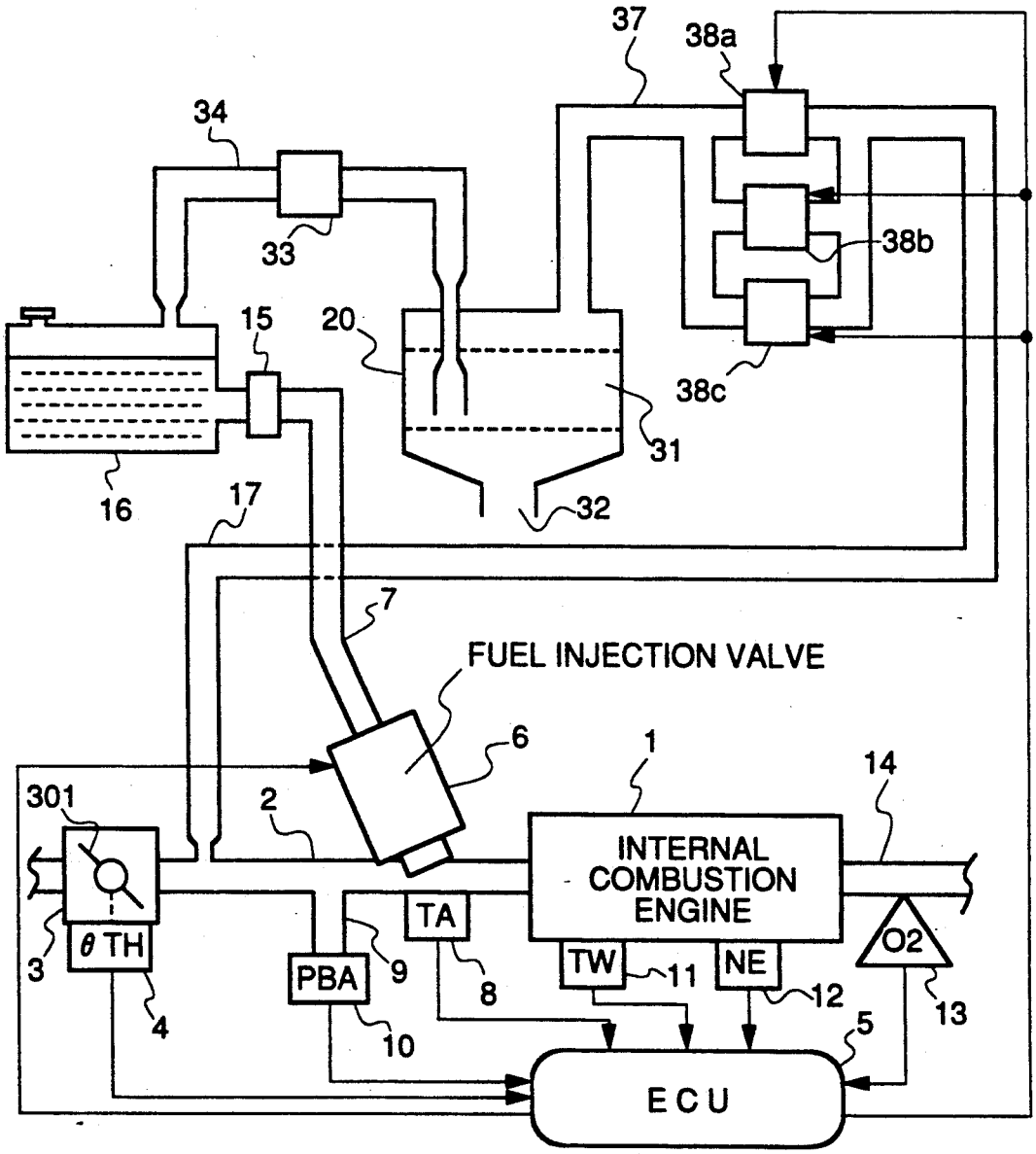
FIG. 6 is a block diagram showing the whole arrangement of an evaporative fuel-purging control system for use in an internal combustion engine, according to a third embodiment of the invention.

FIG. 6 shows a third embodiment of the invention. In FIG. 6, elements and parts corresponding to those in FIG. 1 are designated by identical reference numerals, and description thereof is omitted.

In this embodiment, as shown in FIG. 5, three on-off type flow-rate control valves 38*a*, 38*b*, 38*c* are provided as purging control valves, which are arranged in parallel across a purging pipe 37. More specifically, the on-off type flow-rate control valves 38*a*, 38*b*, 38*c* are selectively on-off controlled to control the purging flow rate by an on-off control signal supplied from the ECU 5. The calculation of the allowable purging flow rate QPGP and the decrease and increase of the purging flow rate are carried out similarly to the first embodiment.

According to the third embodiment, the purging flow rate is controlled to vary in a stepped manner by on-off controlling the on-off-flow-rate control valves 38*a*, 38*b*, 38*c*. Therefore, it is not possible to control the purging flow rate so accurately as in the first or second embodiment. However, the third embodiment is advantageous in manufacturing cost over the previous embodiments.

What is claimed is:

1. In an evaporative fuel-purging control system for an internal combustion engine having an intake system, a fuel tank, a canister in which evaporative fuel from the fuel tank is adsorbed, a purging passage extending between said canister and said intake system, and purging control valve means arranged across said purging passage for controlling a flow rate of said evaporative fuel supplied from said canister to said intake system through said purging passage, the improvement comprising:

purging flow rate-calculating means for integrating an estimated value of said flow rate of said evaporative fuel which is estimated as an allowable purging flow rate in said purging passage in accordance with operating conditions of said engine when said purging control valve means is open to thereby obtain an integrated purging flow rate value, and subtracting a predetermined decremental value from said integrated purging flow rate value when said purging control valve means is closed; and purging flow rate-decreasing means for decreasing said flow rate of said evaporative fuel supplied to said intake system via said purging control valve means when said integrated purging flow rate value obtained by said purging flow rate-calculating means is equal to or smaller than a predetermined lower limit value.

2. An evaporative fuel-purging control system as claimed in claim 1, wherein said purging flow rate-decreasing means decreases said flow rate of said evaporative fuel based upon said integrated purging flow flow rate value obtained by said purging flow rate-calculating means.

3. An evaporative fuel-purging control system as claimed in claim 2, wherein said purging flow rate-decreasing means decreases said flow rate of said evaporative fuel by duty-controlling said purging control valve means, based on said integrated purging flow rate value.

4. An evaporative fuel-purging control system as claimed in claim 1, wherein said operating conditions of said engine comprise rotational speed of said engine and a parameter indicative of load on said engine.

5. An evaporative fuel-purging control system as claimed in claim 1, wherein said purging control valve means comprises a first purging control valve arranged across said purging passage at a location between said canister and said intake system, a negative pressure valve arranged across said purging passage at a location between said first purging control valve and said canister, and a second purging control valve arranged between said negative pressure valve and said intake system for controlling opening of said negative pressure valve by applying vacuum from said intake system thereto.

6. An evaporative fuel-purging control system as claimed in claim 1, wherein said purging control valve means comprises a single flow-rate control valve.

7. An evaporative fuel-purging control system as claimed in claim 1, wherein said purging control valve means comprises a plurality of on-off type purging control valves.

8. In an evaporative fuel-purging control system for an internal combustion engine having an intake system, an exhaust system, a fuel tank, a canister in which evaporative fuel from said fuel tank is adsorbed, a purging passage extending between said canister and said intake system, purging control valve means arranged across said purging pipe for controlling a flow rate of said evaporative fuel supplied from said canister to said intake system, exhaust gas ingredient concentration sensor means arranged in said exhaust system, and air-fuel ratio control means responsive to an output from said exhaust gas ingredient concentration sensor means for calculating an air-fuel ratio correction coefficient, based upon said output from said exhaust gas ingredient concentration sensor and controlling the air-fuel ratio of a mixture supplied to said engine by the use of said air-fuel ratio correction coefficient, the improvement comprising:

purging flow rate-calculating means for integrating an estimated value of said flow rate of said evaporative fuel which is estimated as an allowable purging flow rate in said purging passage in accordance with operating conditions of said engine when said purging control valve means is open to thereby obtain an integrated purging flow rate value, and subtracting a predetermined decremental value from said integrated purging flow rate value when said purging control valve means is closed; and purging flow rate-increasing means for increasing said flow rate of said evaporative fuel supplied to said intake system via said purging control valve means when said air-fuel ratio correction coefficient has a value equal to or greater than a predetermined value and at the same time said integrated purging flow rate value obtained by said purging flow rate calculating means is equal to or greater than a predetermined value.

9. An evaporative fuel-purging control system as claimed in claim 8, wherein said purging flow rate increasing means increases said flow rate of said evaporative fuel, based upon in said integrated purging flow rate value.

10. An evaporative fuel-purging control system as claimed in claim 9, wherein said purging flow rate-increasing means increases said flow rate of said evaporative fuel by duty-controlling said purging control valve means, based upon said integrated purging flow rate value.

11. An evaporative fuel-purging control system as claimed in claim 8, wherein said operating conditions of said engine comprise rotational speed of said engine and a parameter indicative of load on said engine.

12. An evaporative fuel-purging control system as claimed in claim 8, wherein said purging control valve means comprises a first purging control valve arranged across said purging passage at a location between said canister and said intake system, a negative pressure valve arranged across said purging passage at a location between said first purging control valve and said canister, and a second purging control valve arranged between said negative pressure valve and said intake system for controlling opening of said negative pressure valve by applying vacuum from said intake system thereto.

13. An evaporative fuel-purging control system as claimed in claim 8, wherein said purging control valve means comprises a single flow-rate control valve.

14. An evaporative fuel-purging control system as claimed in claim 8, wherein said purging control valve means comprises a plurality of on-off type purging control valves.

15. An evaporative fuel-purging control system as claimed in claim 8, wherein said flow rate of said evaporative fuel supplied to said intake system via said purging control valve means is decreased based upon said integrated purging flow rate value when said air-fuel ratio correction coefficient has a value smaller than said predetermined value.

16. An evaporative fuel-purging control system as claimed in claim 8 or 15, wherein said flow rate of said evaporative fuel supplied to said intake system via said purging control valve means is decreased based upon said integrated purging flow rate value when said integrated purging flow rate value is equal to or smaller than a second predetermined value smaller than said first-mentioned predetermined value.

* * * * *